United States Patent [19]

Allocca

[11] Patent Number: 4,643,584

[45] Date of Patent: Feb. 17, 1987

[54] MOTIONLESS MIXER

[75] Inventor: Peter T. Allocca, Hopedale, Mass.

[73] Assignee: Koch Engineering Company, Inc., Wichita, Kans.

[21] Appl. No.: 774,927

[22] Filed: Sep. 11, 1985

[51] Int. Cl.[4] ..... B01F 5/06

[52] U.S. Cl. ..... 366/337; 165/135

[58] Field of Search ..... 366/336, 337, 338, 339, 366/340, 348, 349; 138/38, 40, 42, 46; 165/135; 48/180 R, 180 M, 180 B

[56] References Cited

U.S. PATENT DOCUMENTS

| | | | |
|---|---|---|---|
| 3,190,618 | 6/1965 | Katzen | 366/337 |
| 3,235,003 | 2/1966 | Smith | 165/135 |
| 3,652,061 | 3/1972 | Chisholm | 366/337 |
| 4,034,965 | 7/1977 | King | 366/336 |
| 4,072,296 | 2/1978 | Doom | 366/337 |
| 4,296,779 | 10/1981 | Smick | 366/337 |
| 4,511,258 | 4/1985 | Fedekighi | 366/337 |

*Primary Examiner*—Louis K. Rimrodt

*Attorney, Agent, or Firm*—Richard P. Crowley

[57] ABSTRACT

A motionless mixer for use in mixing turbulent flow streams in a conduit, which mixer comprises at least first and second pairs of plate elements, the plate elements composed of semielliptical portions disposed at an angle of about 45° from the axis of the conduit, the first and second pairs disposed at an angle of about 90° with respect to each other in the conduit, with the plate elements of each pair overlapping the plate elements of the adjacent pair up to about one-half of the length of the plate elements.

14 Claims, 4 Drawing Figures

MOTIONLESS MIXER

BACKGROUND OF THE INVENTION

Static mixing or motionless mixing apparatuses have been found to be effective for mixing together two or more fluid streams, to prepare a final mixed product. Such static or motionless mixers typically comprise a plurality of baffle-type elements disposed in a particular arrangement within a conduit, the baffle so arranged to provide for a plurality of subdivisions, as two or more streams are passed from the one to the other ends of the conduit containing the motionless mixer. A wide variety of various baffle designs of different shapes and geometric configurations has been proposed and used in connection with motionless mixers. For example, there are many motionless mixers available for the mixing of two or more low-viscosity liquids in turbulent flow; for example, with a Reynolds number of 10,000 or more, such as the mixing of water with hydrocarbons or the mixing of various acids with water in waste-water-treatment processes. While many various motionless mixer designs have been proposed, the overall performance of the mixers varies. The important criteria necessary in the selection of a motionless mixer include factors such as construction simplicity, manufacturing costs, the tendency of the mixer to plug or foul in operation, the pressure drop, the mixing effectiveness, and further the ability of the motionless mixer to pick up dense components from the bottom of a conduit and to mix such components into the main flow stream.

One motionless mixer, which employs semielliptical blade elements, is found in U.S. Pat. No. 3,652,061, which discloses a static mixing element of angularly disposed baffles, which baffles deflect and mix two or more fluid streams passing through the conduit. The individual blades of the baffle assembly are firmly attached to the interior surface of the surrounding conduit. A spiral-flow or mixing system is also described in U.S. Pat. No. 3,235,003, which discloses a plurality of various pairs of semielliptical baffle elements within a conduit, to induce helical flow, which patent relates primarily to mufflers and heat exchangers and the mixing of gases.

SUMMARY OF THE INVENTION

The invention relates to a motionless mixer which includes a conduit defining a flow channel or passageway and a plurality of baffle elements composing a first and second pair of plate elements, the plate elements disposed at an angle to the central axis of the conduit and extending and overlapping the plate elements of each pair. The motionless mixer of the invention is particularly adapted for use in turbulent flow mixing of low-viscosity liquids.

The motionless mixer apparatus of the invention is particularly useful for, but not limited to, the turbulent flow mixing of two or more fluid streams, particularly low-viscosity liquid streams, such as aqueous streams. The motionless mixer provides for a low pressure drop per linear mixture length and exhibits goods pickup characteristics of denser materials from the bottom of the channel of the conduit. Further, the mixer is characterized by simple design and low-cost construction. The motionless mixer is a nonplugging, open-type design composed of a basic unit of at least a first and second pair of blade elements such as elliptical-type blade elements, the blade elements disposed at an angle to the axis of the conduit, with each pair of the blade elements rotated at about 90° to the adjacent pair, and importantly in a meeting, overlapping relationship, such as with up to one-half of the length of the blade elements over and at an angle to the plane of the blade elements of the adjacent pair. The blade elements of the first and second pair are easily and simply secured together, such as by welding at the tips and outer edges, and thus may be slid into a conduit passageway and easily removed for cleaning.

The motionless mixer comprises a basic unit of first and second pairs, but may include a plurality of longitudinally aligned pairs, with every other pair disposed at an angle of 90° to each other, and with the blade elements of each pair overlapping the adjacent pair. The open-type design is nonplugging in character, in that objects of one-half the diameter of the conduit may pass through the static mixer. In addition and importantly, employment of a plurality of the pairs of the motionless mixer provides for a swirling action at the outlet end of the conduit, so that the mixing of two or more fluid streams by the motionless mixer also continues to occur in the pipe conduit downstream of the outlet end of the motionless mixer, without requiring an additional length of the motionless mixer blade elements.

The motionless mixer comprises a plurality of elliptical, and preferably semielliptical, blade or plate elements in at least two pairs, with each adjacent pair of plate elements rotated 90° relative to the other plate element, and preferably the plate elements are composed of semielliptical plate elements, although the plate elements may be made up of portions of elipse, with each pair then comprising an entire elliptical shape, with the exterior elliptical edge of the plate elements placed in a close, sealing relationship with the interior wall of the conduit. Importantly, it has been found that, by overlapping or resting the blade elements of each pair, such as up to about one-half of the length of the adjoining pair, good mixing and pickup characteristics are imparted to the motionless mixer. The plate elements are typically disposed and secured together at an angle of generally 30° to 45° from the axis of the conduit.

The plate elements of each pair are secured together in a defined configuration by a variety of means, and typically, for example, but not limited to, the welding at the midpoint of the major axis of the elliptical edge to the midpoint of the edge of the adjoining plate element, while the pairs are secured together, optionally and typically, by welding or otherwise securing the tip end or edge, wherein the peripheral edge meets the edge of the major axis of the elipse to the outer, central peripheral edge of the overlapping plate element of the adjoining pair. This arrangement permits a plurality of plate elements to be secured together in a number of desired pairs ranging from two, three, four, five or more, and then merely to be slid into the conduit and fit into a relatively snug, sealing fashion against the walls of the conduit by the outside peripheral edges of the elliptical portions of the plate elements. This arrangement avoids the need for specialized interior wall slots or for central rods or tubes to secure together the elements, which leads to difficulty in removing and cleaning the elements, and often tends to increase the pressure drop and reduce the effective mixing length of the blade elements.

The motionless mixer apparatus of the invention comprises a conduit which may be a pipe having a central axis, and is particularly directed to turbulent flow mixing of two or more fluid streams, gas-gas, liquid-liquid or gas-liquid, but optionally may be used for a wide variety of applications, with the motionless mixer characterized by a low pressure drop per linear mixer length and good pickup characteristics, low cost in construction and an open plan design. The motionless mixer typically comprises at least a first and second pair of mixing plate elements, generally each pair having a first and a second plate element, and typically the first plate elements composed of portions of an elipse, and preferably one-half an elipse, with each plate element having a major axis edge and a peripheral edge, and with the first and second plate elements together forming a full elliptical shape. The motionless mixer has the plate elements of each pair disposed at an angle of about 30° to about 60° relative to the central axis of the conduit, and the first and second pairs of each of the plate elements disposed at an angle of about 90° in the conduit, with respect to the adjacent pair. Further and importantly, the first and second elliptical plate elements of each pair overlap the first and second elliptical plate elements of the adjoining pair by up to and typically about one-half of the length of each pair. Therefore, each of the overlapping plate elements are disposed at an angle to the plane of the overlapping plate elements of the adjoining pair. The first and second adjacent and other pairs are secured together in the conduit, generally and preferably by securing together the central area of the elliptical plates at the center, inner edge of each plate, and then the plate elements of each pair are disposed at a 90° angle to the adjacent pair and overlap the adjacent pair by securing the overlapping blade tip areas of the elliptical plate elements to the outer peripheral edge of the adjacent plate elements, and more typically to the outer central peripheral edge of each of the adjoining plate elements.

The blade elements may vary in size and shape and, for example, where a square or rectangular-type conduit is employed, the blade elements may comprise square or rectangular blade elements in the defined overlapping relationship.

The motionless mixer of the invention may be employed in a variety of applications, such as, but not limited to, the efficient admixture and turbulent flow of oil and water, to create a dispersion of the water and oil, or for waste-water treatment, whereby it is desired to mix an acid, such as hydrochloric or sulfuric acid, to an aqueous waste stream to reach a neutral or other defined pH. The addition of acid to the mixer with the water brings down the pH and, after the stream leaves the outlet end of the mixer, because of the motion imparted in the motionless mixer, the liquid stream continues to swirl downstream, to provide additional mixing, and reduces the length of the mixer required.

The motionless mixer may be constructed of a variety of materials and may be used in a variety of applications, wherein motionless or static mixing is required. For the purpose of illustration only, the invention will be described in connection with certain embodiments; however, it is recognized that various changes, improvements and additions may be made to the illustrated motionless mixer, all falling within the spirit and scope of the invention.

DESCRIPTION OF THE EMBODIMENTS

Figure 1:
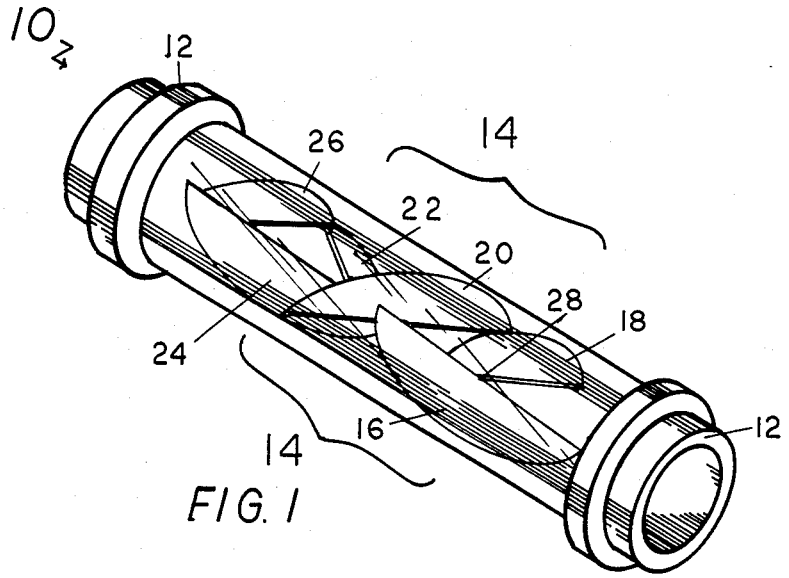
FIG. 1 is a perspective view of a motionless mixer of the invention.
Figure 2:
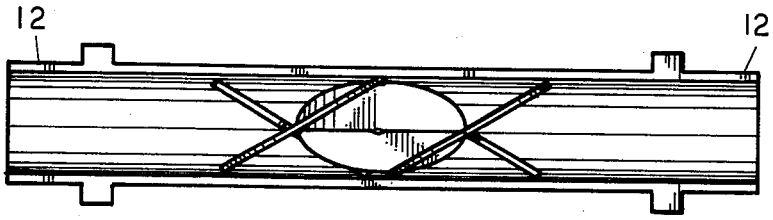
FIG. 2 is a longitudinal, cross-sectional view of the motionless mixer of FIG. 1 along the central axis of the conduit.

FIG. 1 is a perspective view and FIG. 2 is a sectional view of the motionless mixer 10 which includes a cylindrical conduit 10, which conduit contains thereon three pairs of nested, semielliptical blade elements slidably positioned in the cylindrical passageway of the conduit. Any two adjoining pairs; for example, 14 with 14[1], comprise the basic pair of blade elements of the invention. Semielliptical blade elements 16 and 18 form a first pair, 20 and 22 form the middle second pair, and 24 and 26 form the third last pair.

As illustrated, each pair is disposed to the adjoining pair at an angle of 90° to the axis of the conduit. The blade elements of each pair 16 and 18, 20 and 22 and 24 and 26 are secured together, such as by spot-welding 28, 30 and 32, at the middle of the major-axis straight edge of the blade elements, with the plane of each blade element at an angle of 30° from the axis of the conduit 12. The blades of each pair are in a nesting, overlapping relationship with the blades of the adjoining pair, with the edge tips of the overlapping blade elements secured, such as by spot-welding 34, 36, 38 and 40, to the middle, outer ellipsoidal edge of the overlapped blade elements.

The blade elements have the outer ellipsoidal edge in a close, snug-fitting, but slidable, relationship with the interior wall of the conduit 12. As illustrated, the blade elements overlap about one-half of the axial length of the adjoining blade elements. This arrangement permits more pair elements to be inserted easily into a fixed length of the conduit, than with nonnesting elements. The end pairs may be retained in position during use, by welding or the use of nonsliding plugs, or raised shoulders in the conduit passageway, adhesives, or other securing means, to prevent the movement of the pairs once in position.

Figure 3:
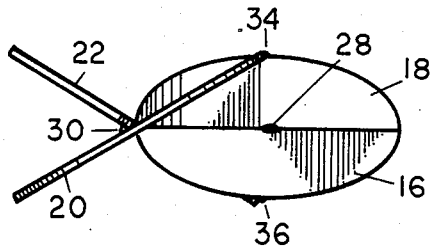
FIG. 3 is a side view of a basic unit pair of the motionless mixer of the invention.
Figure 4:
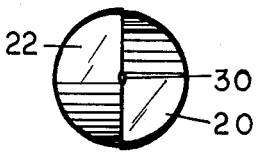
FIG. 4 is an end view of the basic unit pair of the motionless mixer of FIG. 3, viewing FIG. 3 from the left-hand side.

FIG. 3 is a side plan view of a basic pair of blade elements 16, 18, 20 and 22, while FIG. 4 is an end plan view of FIG. 3 taken from the left-hand side of FIG. 3.

A comparison test was carried out employing a basic unit of a two-pair, semielliptical-bladed, motionless mixer of the invention, as illustrated in FIGS. 3 and 4, with commercially available motionless mixers, in respect to pressure drop, mixing ability and pickup capability. The test was carried out by the turbulent mixing of an aqueous stream containing dye of 1 part per 100 parts of water in a 2-inch pipe in a turbulent mixing of the two liquid streams, with the following results:

| Mixer | ΔP @ 10 gpm* ("w.c.) | $L_M$ @ 10 gpm** (diameters) | Mixer Length (") | Pickup Capability @ 5 gpm |
|---|---|---|---|---|
| Komax[1] | 2.8 | 28 | 6.6 | Fair–Good |

-continued

| Mixer | ΔP @ 10 gpm* ("w.c.) | $L_M$ @ 10 gpm** (diameters) | Mixer Length (") | Pickup Capability @ 5 gpm |
|---|---|---|---|---|
| Ross[2] | 3.8 | 14 | 5.0 | Good-Very Good |
| Koflo[3] | 1.1 | >48 | 5.5 | Fair-Good |
| Kenics[4] | 1.3 | 28 | 6.1 | Fair-Good |
| Statiflo[5] | 1.2 | 38 | 6.25 | Fair |
| Invention (plates at 30° from axis) | 1.2 | 26 | 5.5 | Good-Very Good |

*Re = 15,760 @ 10 gpm

**$L_M$ = the number of diameters downstream of the dye injection point at which the mixture is visually completely homogeneous in both radial and axial directions.

[1]Komax is a registered trademark of Komax Systems, Inc. (see U.S. Pat. No. 4,034,965).

[2]Ross is a trademark of Charles Ross & Son Company (see U.S. Pat. No. 3,652,061-mixer tested had plates at 45° axis)

[3]Koflo is a trademark of Koflo Corporation (see U.S. Pat. No. 4,072,296)

[4]Kenics is a trademark of Clevepak Corporation (see bow-tie-type mixer shown in U.S. Pat. No. 4,314,974)

[5]Statiflo is a trademark of Cleveland Mixed Division of EMI, Inc. (see U.S. Pat. No. 4,072,296)

As illustrated by the comparative data above, the motionless mixer of the invention provides for both good pickup characteristics and low pressure drop. Further, as illustrated, the motionless mixer of the invention is of an open-plug design and is easily fabricated at low cost and is simply installed and removed from the conduit, while providing the additional advantage of a swirling motion in the conduit downstream of the motionless mixer blade outlet.

What is claimed is:

1. A motionless mixer for use in a conduit, having an axis to provide for the turbulent flow mixing of two or more fluid streams, with a low pressure drop per linear mixer length and with good pickup characteristics, and which mixer apparatus comprises in combination:

(a) a plurality of pairs of mixing plate elements composed of at least a first and second pair of mixing plate elements, each pair having a first and second plate element, each plate element having inner and outer edges;

(b) the plate elements of each pair disposed at an angle of about 30° to 60° from the axis of the conduit;

(c) the pairs of mixing plate elements in the conduit disposed at an angle of about 90° with respect to each other;

(d) the first and second plate elements of each pair of mixing plate elements disposed in a nesting overlapping relationship with the first and second plate elements of the adjacent pair, so that each of the plate elements is disposed at an angle to the plane of the overlap plate element; and (e) means to secure together the first and second plate elements of each pair in the desired angular relationship and to secure the plate elements overlapping the adjacent pairs to the overlap plate elements.

2. The mixer of claim 1 wherein the first and second plate elements of each pair are composed of portions of an elipse having a plate tip at each end, and the first and second plate elements together of each pair forming a full elliptical shape, wherein the conduit comprises a cylindrical passageway.

3. The mixer of claim 2 wherein the plate elements of the first and second pair are secured together in a nesting overlapping relationship, by securing the plate tips of the overlapping plate elements of each pair to the outer edge of the overlapped plate elements.

4. The mixer of claim 2 wherein the plate elements comprise semielliptical plate elements and the semielliptical plate elements of each pair are secured together at the internal edge and the nesting overlapping plate elements are secured at their outer tips to the outer peripheral edge of the overlapped elements of the next adjacent pair.

5. The mixer of claim 1 wherein the plate elements are disposed at an angle of about 30° to 60° from the axis of the conduit.

6. The mixer of claim 1 wherein the plate elements of each pair are secured together at the middle intercepting edge of each element.

7. The mixer of claim 1 wherein the conduit extends beyond the outlet end of the plurality of motionless mixers, to permit the mixed fluids to swirl in the extended conduit.

8. The mixer of claim 1 which includes a conduit having an inlet end for the introduction of fluids to be mixed and an outlet end for the removal of mixed fluids, and which includes the motionless mixer disposed in the conduit for the mixing of fluids.

9. A motionless mixer for the turbulent flow mixing of two or more fluid streams, which mixer comprises:

(a) a conduit having an interior wall surface, to define a cylindrical passageway with a central axis, and an inlet end for the introduction of fluids to be mixed and an outlet end for the removal of mixed fluids; and (b) a mixer apparatus which comprises (i) a plurality of pairs of semielliptical plate elements composed of at least a first and a second pair, the pairs each composed of first and second semielliptical mixing plate elements, the mixing plates having an internal major axis edge, an external, semielliptical edge and a blade tip at each end where the edges meet, (ii) the plate elements of each pair secured together at about the midpoint of the major axis edge at an angle of about 30° to 60° from the central axis of the conduit, (iii) each pair of the plate elements disposed in the conduit at an angle of about 90° with respect to the adjoining pair, (iv) the first and second plate elements of each pair disposed in an overlapping, nesting relationship with the first and second plate elements of each adjoining pair of about one-half the length of the major axis of the plate elements, and (v) means to secure the plate elements in the nesting, overlapping relationship within the conduit, which includes securing the plate tips of the overlapped plate elements to the external edge of the adjoining plate elements, the plate elements so secured adapted to be positioned slidably in the passageway in a snug relationship within the passageway and to have the peripheral, external edge of the plate elements in a snug relationship with the interior wall of the passageway.

10. A method of mixing two or more turbulent, low-viscosity fluid streams, which method comprises:

(a) introducing the two or more low-viscosity, turbulent-flow fluid streams into one end of a conduit which contains therein a motionless mixer which comprises (i) a plurality of pairs of mixing plate elements composed of at least a first and second pair of mixing plate elements, each pair having a first and second plate element, each plate element having inner and outer edges, (ii) the plate elements of each pair disposed at an angle of about 30° to 60° from the axis of the conduit, (iii) the pairs of mixing plate elements in the conduit disposed at an angle of about 90° with respect to each other, (iv) the first and second plate elements of each pair of mixing plate elements disposed in a nesting overlapping relationship with the first and second plate elements of the adjacent pair, so that each of the plate elements is disposed at an angle to the plane of the overlap plate element, and (v) means to secure together the first and second plate elements of each pair in the desired angular relationship and to secure the plate elements overlapping the adjacent pairs to the overlap plate elements; and (b) withdrawing from the other end of the conduit a mixed fluid stream.

11. The method of claim 10 which includes extending the other end of the conduit beyond the end of the motionless mixer, to provide for the continued mixing of the fluid stream in the extended conduit, after discharge of the fluid stream from the other discharge end of the motionless mixer.

12. The method of claim 10 wherein the plate elements are elliptical plate elements disposed at an angle of about 30° from the axis of the conduit.

13. The method of claim 10 wherein one fluid stream to be mixed comprises a water stream, and the other fluid stream to be mixed comprises an oil stream.

14. The method of claim 10 wherein one fluid stream to be mixed comprises an aqueous waste-water stream, and the other fluid stream to be mixed comprises an aqueous acid-containing stream.

* * * * *